US005161966A

United States Patent [19]

Obermueller

[11] Patent Number: 5,161,966

[45] Date of Patent: Nov. 10, 1992

[54] METHOD AND APPARATUS FOR BURNING A POLLUTANTS CONTAINED IN A CARRIER FLOW

[75] Inventor: Herbert Obermueller, Linsengericht, Fed. Rep. of Germany

[73] Assignee: H. Krantz GmbH & Co., Aachen, Fed. Rep. of Germany

[21] Appl. No.: 823,048

[22] Filed: Jan. 16, 1992

Related U.S. Application Data

[63] Continuation of Ser. No. 667,517, Mar. 11, 1991, abandoned.

[30] Foreign Application Priority Data

Mar. 10, 1990 [DE] Fed. Rep. of Germany ..... 4007624

[51] Int. Cl.[5] ..... F23J 15/00; F23B 5/00

[52] U.S. Cl. ..... 432/72; 110/211; 110/212

[58] Field of Search ..... 432/72; 110/210-214

[56] References Cited

U.S. PATENT DOCUMENTS

| | | | |
|---|---|---|---|
| 3,898,040 | 8/1975 | Tabak | 110/211 |
| 3,947,235 | 3/1976 | Bornet | 432/72 |
| 4,038,032 | 7/1977 | Brewer et al. | 110/212 |
| 4,098,567 | 7/1978 | Hubbert | 432/72 |
| 4,771,707 | 9/1988 | Robson et al. | 110/211 |
| 4,951,579 | 8/1990 | Bell | 110/212 |

FOREIGN PATENT DOCUMENTS 3605415 8/1987 Fed. Rep. of Germany .

*Primary Examiner*—Henry C. Yuen
*Attorney, Agent, or Firm*—W. G. Fasse

[57] ABSTRACT

In a method and apparatus for cleaning a gas flow that carries oxidizable pollutants in varying concentrations, the temperature within the combustion apparatus is maintained substantially constant by admixing controllable proportions of the gas to be cleaned and/or fresh air to the combustion flow. However, admixing prior to introducing the gas to be cleaned into the combustion flow is avoided by performing the admixing at a location near the exit end of a flue gas mixing pipe. This mixing location permits maintaining the combustion chamber temperature constant or at its rated level while simultaneously keeping the temperature of the flow control device at acceptable levels. The flue gas mixing pipe is arranged downstream and coaxially with a burner so that the admixing takes place after the combustion or carrier flow has already passed the burner at the entrance to the combustion chamber.

9 Claims, 2 Drawing Sheets

METHOD AND APPARATUS FOR BURNING A POLLUTANTS CONTAINED IN A CARRIER FLOW

This application is a file wrapper continuation of application Ser. No. 07/667,517, filed on Mar. 11, 1991, abandoned.

CROSS REFERENCE TO RELATED APPLICATIONS

The present invention relates to the following U.S. patent applications:

1) U.S. Ser. No. 07/667,514, filed Mar. 11, 1991;
2) U.S. Ser. No. 07/667,516, filed Mar. 11, 1991 abandoned;
3) U.S. Ser. No. 07/667,513, filed Mar. 11, 1991.

FIELD OF THE INVENTION

The invention relates to a method for burning pollutants contained in a carrier flow, for example in exhaust gases. The apparatus for performing the method includes heat exchanger pipes through which the carrier flow must travel for preheating the carrier flow prior to its introduction into a combustion chamber.

BACKGROUND INFORMATION

In a known apparatus for the cleaning of carrier gas flows the flow is conducted through a flue gas mixing pipe which is concentrically surrounded by a main combustion chamber into which the gas flows from the flue gas mixing pipe. Finally, the cleaned gas is used to preheat the contaminated gas. For this purpose, the cleaned gas flows around the heat exchanger pipes which carry the contaminated gas to the burner.

The just mentioned apparatus for the burning of contaminants or pollutants contained in a carrier or medium flow comprises a cylindrical housing with an inlet port and an outlet port for the gas flow. The incoming, contaminated gas flow enters through heat exchanger pipes into a ring chamber surrounding the burner at one end of the housing. The gas flows past the burner into the above mentioned flue gas mixing pipe which is arranged axially aligned with the burner in the housing. The heat exchanger pipes are arranged in a cylindrical configuration and extend axially inside the housing. The flue gas mixing pipe leads into a main combustion chamber and from there the gas, which is now cleaned, is guided over and around the heat exchanger pipes to flow out through an outlet port.

The temperature in the combustion chamber must be maintained so that it does not exceed a rated level. For this purpose, the proportion of oxidizable components in the medium or carrier flow must also be limited to a fixed quantity in order to assure that even at the minimum burner performance, the combustion chamber temperature is maintained at said rated level.

In order to nevertheless be able to treat carrier flows containing larger quantities or proportions of oxidizable components, it is known from German Patent Publication (DE-OS) 3,605,415, to mix at least a proportion of the incoming contaminated gas flow inside the combustion apparatus with already cleaned exhaust gas and also with fresh air. The proportion of already cleaned exhaust gas is either discharged after it has flown around the heat exchanger pipes or it is discharged directly out of the combustion chamber for the mixing purpose. In both instances, the proportion of already cleaned gas needed for the admixing must be returned into the apparatus through a special duct system. Such an arrangement is supposed to avoid exposing sensitive components of the apparatus to high temperatures. Such components may include control flaps or valves which are required to operate exactly in response to pressure variations and which are required to have the necessary sealing abilities. Accordingly, in order to perform the above mentioned known method it is practically impossible to avoid a relatively large structural effort and expense.

OBJECTS OF THE INVENTION

In view of the foregoing it is the aim of the invention to achieve the following objects singly or in combination:

to provide a method of the type mentioned above in which the temperature in the combustion chamber is maintained at a constant level even if the carrier gas flow to be cleaned carries varying proportions or concentrations of oxidizable components;

to avoid reducing the concentration of oxidizable components in the gas flow to be cleaned prior to introducing the gas flow into the combustion apparatus by way of admixing cleaned gas or fresh air to the flow to be cleaned;

to provide an admixing of gas to be cleaned and/or fresh air at a location within the main flow where such admixing is more convenient than heretofore; and to construct an apparatus which permits the admixing of gas to be cleaned and/or fresh air to the main gas flow within the combustion apparatus after the main flow has already passed the burner and a substantial portion of the flue gas mixing pipe.

SUMMARY OF THE INVENTION

The above objects have been achieved according to the invention by admixing a variable proportion of the pollutants carrying flow and/or a proportion of fresh air, to the carrier gas flow to be cleaned more or less where the gas flow exits from the flue gas mixing pipe and enters a combustion chamber. Preferably, the admixing of gas to be cleaned and/or fresh air takes place immediately near the exit from the flue gas mixing pipe, where a mixed gas flow emerging from the flue gas mixing pipe enters into the combustion chamber.

It has been found that the temperature in the combustion chamber can be effectively maintained at a constant level by the teaching according to the invention. Such mixing near the exit of the flue gas mixing pipe is surprisingly capable of effectively influencing the operating temperature inside the combustion chamber. Such influencing of the operating temperature is possible because the flue gas mixing pipe extends concentrically inside the combustion chamber, whereby the mixed gas flows during its passage through a main combustion chamber, along the entire length of the flue gas mixing pipe, thereby influencing the temperature in the combustion chamber. Additionally, the combustion chamber temperature is influenced by the temperature of the carrier or medium gas flow passing out of the heat exchanger pipes to the burner. According to the invention it is not necessary to supply an already premixed gas flow to the burner. This is so because the temperature of the gas to be cleaned flowing through the heat exchanger pipes, depends on the temperature of the gas flowing around the heat exchanger pipes and the last mentioned temperature in turn depends on the admixing as taught herein. Accordingly, the temperature of the gas to be cleaned and flowing out of the heat exchanger pipes to the burner is also influenced by the present admixing without the need for admixing already cleaned gas and/or fresh air to the gas to be cleaned flowing to the burner.

The apparatus for performing the present method is characterized according to the invention by an inlet chamber connected on the one hand to an inlet port, and on the other hand to the inlet ends of the heat exchanger pipes, and in that a by-pass including adjustable flow control means leads directly from the inlet chamber into the flue gas mixing pipe, whereby a portion of the by-pass is arranged concentrically in the exit end of the flue gas mixing pipe, where a mixed gas flow emerging from the flue gas mixing pipe enters into the main combustion chamber. These features make it possible to control the flow cross-sectional area of the by-pass by means of a flap valve or the like which is still located inside the inlet chamber portion of the by-pass so that it is not exposed to higher temperatures, especially since the proportion of the incoming volume flow that is flowing through the bypass has a relatively low temperature, thereby cooling the inlet of the by-pass and the flap valve arranged in the by-pass inlet. The by-pass itself is constructed as a pipe section, the cylindrical walls of which are provided with apertures where the pipe section reaches into the flue gas mixing pipe and into the spacing between the open end of the flue gas mixing pipe and the end wall of the combustion chamber that separates the combustion chamber from the inlet chamber. Additionally, the burner facing end of the by-pass pipe section is closed, preferably by a streamlined bottom. This type of construction permits the introduction of gas still to be cleaned and/or fresh air into the gas flow being cleaned, whereby such introduction results in an intensive mixing of the temperature controlling gases flowing out of the apertures of the by-pass pipe section and the gases flowing through the flue gas mixing pipe, downstream of the burner.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
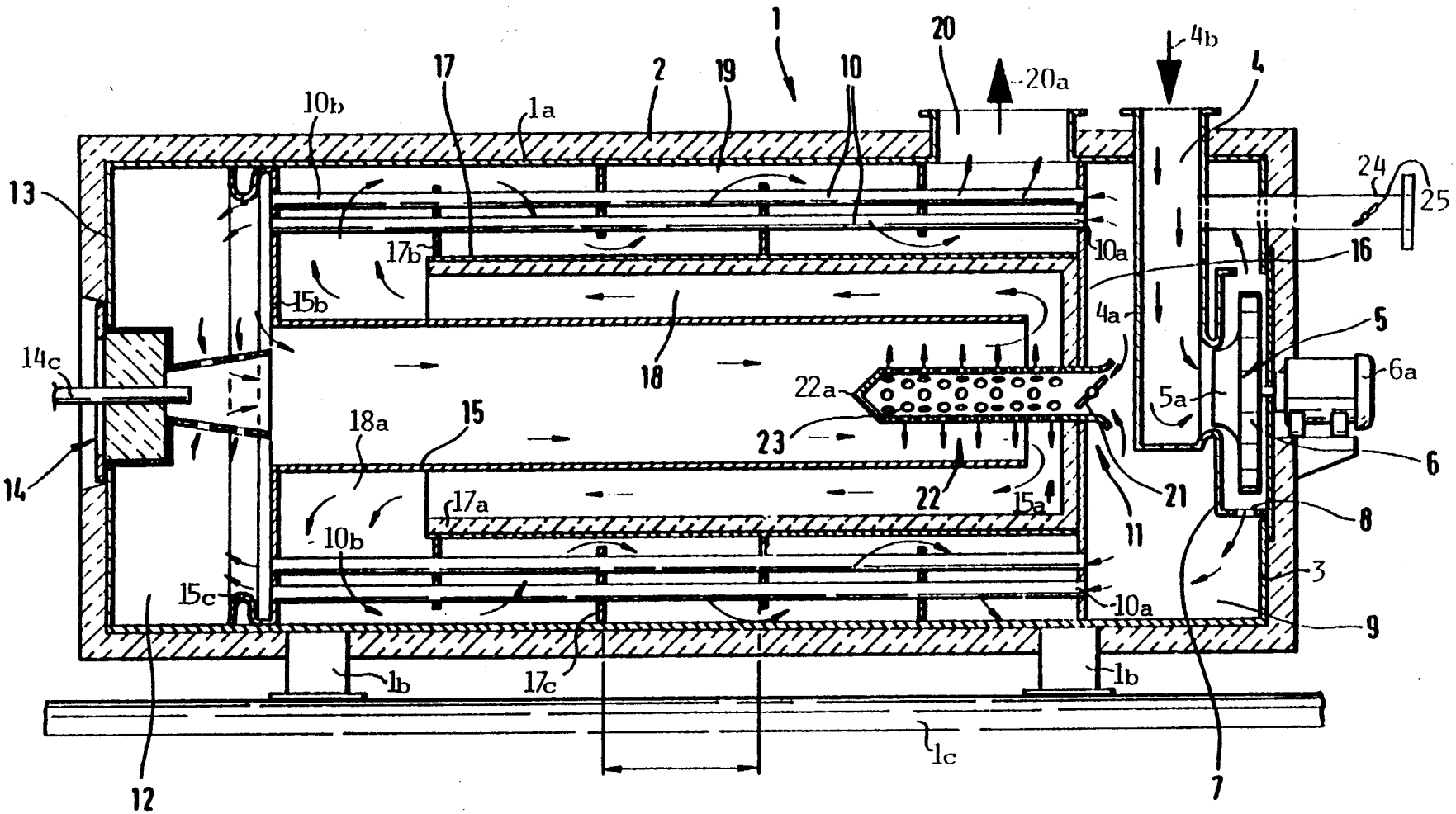
FIG. 1 is an axial longitudinal section through an apparatus equipped according to the invention for the gas temperature control near the exit end of the flue gas mixing pipe.

Referring to FIG. 1 the present gas cleaning apparatus comprises a housing 1 including a cylindrical metal shell 1*a* surrounded by heat insulation 2. The right-hand end is closed by an end wall 3. The left-hand end is closed by an end wall 13. An inlet port 4 leads through an inlet duct 4*a* to the intake 5*a* of a radial blower 5 mounted concentrically in the end wall 3. The radial blower 5 has a propeller wheel 6 driven by a motor 6*a* for blowing the incoming gas indicated by an arrow 4*b* radially outwardly through a ring gap or slot 8 in a housing 7 surrounding the radial blower 5. The slot 8 leads into an inlet chamber 9 of the housing 1. The inlet chamber 9 is closed by a radially extending separation wall 16 provided with holes into which the open inlet ends 10*a* of heat exchanger pipes 10 are welded or brazed.

According to the invention a by-pass 11 is concentrically mounted in the separation wall 16. The by-pass 11 comprises a pipe section 22 with apertures 23 in its wall at least where the pipe section 22 reaches into a flue gas mixing pipe 15 to be described below. The apertures 23 may also be provided in the pipe section 22 where the pipe section passes through a spacing 15*a* between the right-hand open end of the flue gas mixing pipe 15 and the separation wall 16. The right-hand end of the by-pass pipe section 22 is open and reaches into the inlet chamber 9. The left-hand end of the pipe section 22 has a closed bottom 22*a* which is preferably streamlined to face the flow inside the flue gas mixing pipe 15. A flow control device 21, such as a flap valve or double flap valve is located in the inlet end of the by-pass pipe section 22 for controlling the flow cross-sectional area into the by-pass 11.

The heat exchanger pipes 10 extend coaxially around a central axis of the cylindrical housing 1 and along a substantial proportion of the axial length of the housing. The exit end 10*b* of each open ended heat exchanger pipe 10 is welded into a respective hole in an end flange 15*b* of the flue gas mixing pipe 15. Thus, the gas passing through the heat exchanger pipes 10 enters into a ring chamber 12 formed between the end wall 13 and the flange 15*b*. The ring chamber 12 forms a first portion of a combustion chamber which surrounds a burner 14 receiving fuel through a fuel pipe 14*a*. The burner is arranged concentrically in the chamber 12 and coaxially to the flue gas mixing pipe 15. Thus, the burner 14 opens into the pipe 15. The end flange 15*b* of the pipe 15 extends radially and has a corrugated collar 15*c*. The collar 15*c* performs three functions. First, it deflects the gas exiting from the heat exchanger pipe ends 10*b* toward the burner 14. Second, the collar 15*c* firmly supports the pipe 15 in the housing casing 1*a* which is mounted on brackets or legs 1*b* on a support 1*c*. Third, the corrugation of the collar 15*c* of the pipe 15 properly guides pipe 15 in the housing to accommodate heat expansions and contractions.

The right-hand opening of the flue gas mixing pipe 15 is spaced from the separation wall 16 by the above mentioned spacing 15*a* so that the gas exiting from the pipe 15 can enter into inlet zone of a second portion forming a main combustion chamber 18 between the pipe 15 and a cylinder 17 surrounding the flue gas mixing pipe 15 with a radial spacing and preferably concentrically. The cylinder 17 is connected at its right-hand end to the separation wall 16 and the chamber thus formed is lined with heat insulation 17*a*. The cylinder 17 with its heat insulation 17*a* extends along a substantial length of the pipe 15, but is shorter than the pipe 15 to form a flow diverting ring chamber 18*a* in which the gas exiting from the main combustion chamber 18 is diverted to flow through a ring space 19 formed between the cylinder 17 and the jacket 1*a* of the housing 1.

Due to the just described construction, the flue gas mixing pipe 15 is surrounded by the main combustion chamber 18 substantially along the entire length of the flue gas mixing pipe 15, so that gas exiting from the flue gas mixing pipe 15 and gas entering through the by-pass 11 enter into said inlet zone at 15*a* of said main combustion chamber 18 for an effective control of the operating temperature in said main combustion chamber even if the proportions of oxidizable components are varying in said gas to be cleaned.

The heat exchanger pipes 10 are arranged in this ring space 19 for preheating the incoming gas to be cleaned before it is supplied into the ring chamber 12 around the burner 14. Baffle plates 17*b* and 17*c* extend into the ring space 19 to cause the exit flow to meander around the heat exchanger pipe 10 for an efficient heat exchange. The ring space 19 leads into an exit port 20 through which the cleaned gas is discharged as indicated at 20*a*.

The above mentioned control device or flap 21 in the by-pass 11 makes it possible to divert a controlled proportion of the gas to be cleaned directly into the combustion flow through the apertures 23, whereby the diverted proportion does not flow through the heat exchanger pipes 10 nor through the ring chamber 12 and also not through the burner 14. The diverted proportion of the gas to be cleaned is mixed with the flow in the flue gas mixing pipe 15 in a transition area at the exit of the flue gas mixing pipe 15 and the entrance into the main combustion chamber 18, whereby the temperature of the gas in the pipe 15 and in the combustion chamber 18 can be effectively controlled and held substantially constant independently of any changes in the proportion of oxidizable components in the gas to be cleaned.

Figure 2:
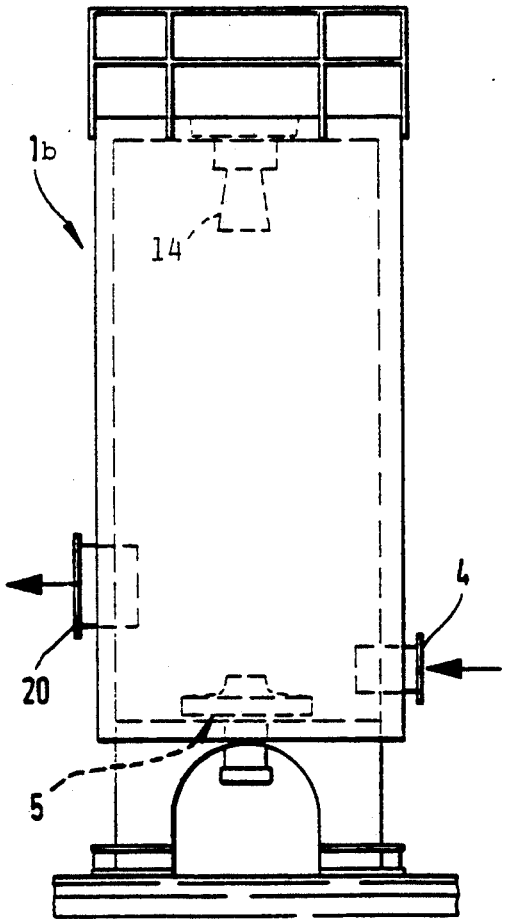
FIG. 2 is a schematic illustration of an embodiment of the invention in which the housing is arranged vertically, and in which the inlet and outlet ports are located near the lower end of the housing.

FIG. 2 shows an embodiment of the invention in which the housing 1*b* is arranged vertically, rather than horizontally. The burner 14 is arranged at the top and the radial blower 5 is arranged at the bottom of the housing 1*b*. The inlet port 4 and the outlet port 20 are arranged closer to the bottom.

Figure 3:
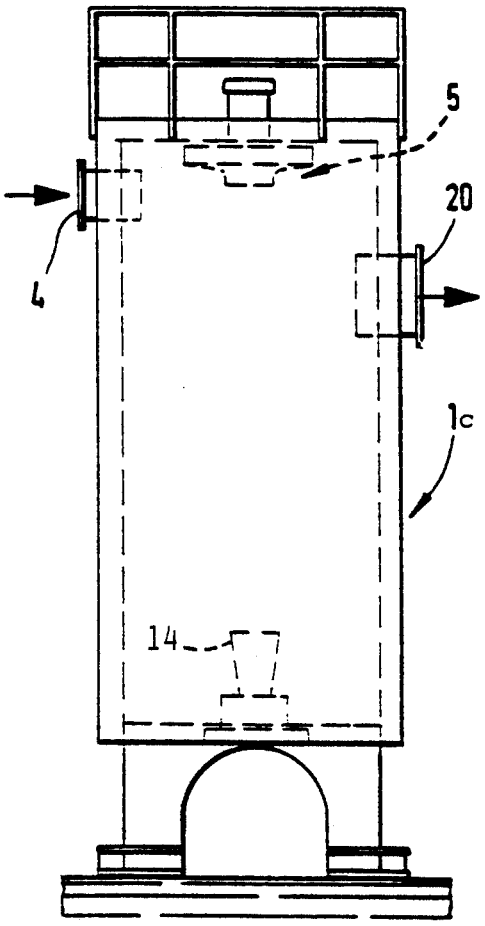
FIG. 3 is a view similar to that of FIG. 2, however, showing the inlet port and the outlet port located closer to the top end of the housing.

In FIG. 3 the arrangement is reversed. Thus, the burner 14 is arranged at the bottom and the blower 5 is arranged at the top of the housing 1*c*. The inlet port 4 and the outlet port 20 are arranged closer to the top.

Referring again to FIG. 1, a fresh air intake 24 leads into the flow duct 4*a*. A control member 25 in the air intake 24 permits controlling the flow cross-sectional area of the air intake so that fresh air may also be admixed into the gas to be cleaned. Another position for the fresh air intake may be so arranged that fresh air and/or gas to be cleaned can be supplied directly into the by-pass 11.

Although the invention has been described with reference to specific example embodiments it will be appreciated that it is intended to cover all modifications and equivalents within the scope of the appended claims.

What I claim is:

1. A method for controlling an operating temperature in an apparatus for burning pollutants out of a carrier gas flow to be cleaned, said carrier gas flow containing varying proportions of oxidizable components, said apparatus including a gas flow path extending from an inlet port (4) to an outlet port (20), said gas flow path including an inlet chamber (9) connected to said inlet port (4) for receiving said carrier gas flow (4*b*), heat exchanger pipes (10) mounted in a ring space (19) for receiving said carrier gas flow from said inlet chamber (9), a first combustion chamber (12) with a burner (14) receiving said carrier gas flow out of said heat exchanger pipes (10), a flue gas mixing pipe (15) receiving a gas flow from said first combustion chamber (12), a second combustion chamber (18) receiving gas from said flue gas mixing pipe (15), said ring space (19) receiving hot gasses at one end (18*a*) from said second combustion chamber (18), said ring space (19) leading to said exit port (20) at an opposite end thus completing said gas flow path with a flow direction from said inlet port (4) to said exit port (20); said method comprising the following steps:

a) feeding said carrier gas flow to be cleaned through said gas flow path;

b) diverting a controllable portion of gas in said inlet chamber from flowing directly into said heat exchanger pipes (10);

c) admixing said controllable portion of gas into said carrier gas flow at a location near an exit end of said flue gas mixing pipe (15) and near an inlet end of said second combustion chamber (18);

d) causing gas flowing out of said flue gas mixing pipe (15) and said controllable portion of gas to flow along the length of said flue gas mixing pipe (15) as said gasses flow through said second combustion chamber (18); and e) controlling the volume of said controllable gas portion for said admixing so that said operating temperature in said second combustion chamber (18) remains substantially constant even if variations occur in said proportions of oxidizable components in said carrier gas flow to be cleaned.

2. The method of claim 1, wherein said controlling step is performed in a by-pass (11) leading directly from said inlet chamber (9) into an exit end of said flue gas mixing pipe (15).

3. An apparatus for controlling an operating temperature while burning pollutants out of a carrier gas flow to be cleaned, said carrier gas flow containing varying proportions of oxidizable components, said apparatus comprising a housing (2) with an inlet port (4) for said carrier gas flow (4*b*) and an outlet port (20) for cleaned gas, a gas flow path arranged in said housing (2), said gas flow path including an inlet chamber (9) connected to said inlet port, open ended heat exchanger pipes (10) connected at one end to said inlet chamber (9) for receiving gas from said inlet chamber, a first combustion chamber (12) connected to an opposite end of said heat exchanger pipes (10) for receiving preheated gas through said heat exchanger pipes (10), a burner (14) in said first combustion chamber (12), a flue gas mixing pipe (15) arranged coaxially with said burner for receiving gasses from said first combustion chamber (12), said flue gas mixing pipe having an inlet end facing said burner (14), a second combustion chamber (18) surrounding said flue gas mixing pipe (15) substantially along the entire length of said flue gas mixing pipe (15), said second combustion chamber (18) having an inlet zone (15*a*) communicating with an exit end of said flue gas mixing pipe (15), a ring space (19) surrounding said second combustion chamber (18), said heat exchanger pipes (10) being arranged in said ring space (19), one end of said ring space (19) communicating with said second combustion chamber (18), an opposite end of said ring space (19) communicating with said outlet port (20) for discharging cleaned gas, by-pass means (11) leading from said inlet chamber (9) into said exit end of said flue gas mixing pipe (15) for diverting a proportion of gas from said inlet chamber (9) into a space near said exit end of said flue gas mixing pipe (15) communicating with said inlet zone (15*a*) of said second combustion chamber (18), and control means in said by-pass means

(11) for controlling a volume of by-pass gas flow and thereby the operating temperature inside said second combustion chamber (18) so that said operating temperature is maintained substantially constant even if variations in said proportions of oxidizable components in said carrier gas flow to be cleaned occur.

4. The apparatus of claim 3, wherein said by-pass means (11) comprise a pipe section (22) arranged concentrically in said housing and reaching coaxially into said exit end of said flue gas mixing pipe (15), said pipe section (22) having an open end in said inlet chamber (9) and a closed end in said flue gas mixing pipe (15), said pipe section (22) having lateral gas outlet apertures (23) in its side wall for passing gas into a gas flow near said exit end of said flue gas mixing pipe (15).

5. The apparatus of claim 4, wherein said control means comprise a flap valve (21) in said open end of said pipe section (22) of said by-pass means (11).

6. The apparatus of claim 4, wherein said exit end of said flue gas mixing pipe (15) is spaced by a spacing (15*a*) from a separation wall (16) separating said inlet chamber (9) from said flue gas mixing pipe (15) and from said inlet zone of said second combustion chamber (18) surrounding said flue gas mixing pipe (15), said by-pass section (22) passing through said spacing (15*a*), said gas outlet apertures (23) being positioned for passing gas into said spacing (15*a*) forming said inlet zone of said second combustion chamber (18), said exit end of said flue gas mixing pipe leading into said spacing (15*a*).

7. The apparatus of claim 3, further comprising blower means (5) for blowing gas to be cleaned into said inlet chamber (9).

8. The apparatus of claim 3, wherein said flue gas mixing pipe (15) has an end flange (15*b*) extending radially outwardly at said inlet end of said flue gas mixing pipe (15) near said burner (14), said end flange (15*b*) having a corrugated rim (15*c*) circumferentially bearing against an inner surface of said housing (2) for mounting said flue gas mixing pipe (15) in said housing (2) to permit temperature responsive expansions and contractions of said flue gas mixing pipe.

9. The apparatus of claim 3, wherein said flue gas mixing pipe (15) is surrounded concentrically by said second combustion chamber (18).

* * * * *